US007013952B2

(12) United States Patent
Park et al.

(10) Patent No.: US 7,013,952 B2
(45) Date of Patent: Mar. 21, 2006

(54) STACK TYPE HEAT EXCHANGER

(75) Inventors: Tae Young Park, Daejeon (KR); Chang-Ho Park, Daejeon (KR); In Kap Kim, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 249 days.

(21) Appl. No.: 10/615,988

(22) Filed: Jul. 10, 2003

(65) Prior Publication Data

US 2004/0035564 A1 Feb. 26, 2004

(30) Foreign Application Priority Data

Jul. 11, 2002 (KR) ..... 10-2002-0040393

(51) Int. Cl.
*F28D 1/03* (2006.01)

(52) U.S. Cl. ..... 165/78; 165/153; 165/176

(58) Field of Classification Search ..... 165/148, 165/152, 153, 176, 78
See application file for complete search history.

(56) References Cited

U.S. PATENT DOCUMENTS 3,207,216 A * 9/1965 Donaldson ..... 165/148
4,274,482 A * 6/1981 Sonoda ..... 165/153
4,470,455 A * 9/1984 Sacca ..... 165/167
4,592,414 A * 6/1986 Beasley ..... 165/153
5,529,116 A * 6/1996 Sasaki et al. ..... 165/144
5,720,341 A * 2/1998 Watanabe et al. ..... 165/153
5,918,664 A * 7/1999 Torigoe ..... 165/78
6,920,916 B1 * 7/2005 Higashiyama ..... 165/153
2002/0043361 A1 * 4/2002 Saito et al. ..... 165/153

FOREIGN PATENT DOCUMENTS

JP 7-12778 U 3/1995
JP 10-325645 12/1998
JP 2000-105091 4/2000

* cited by examiner

*Primary Examiner*—Leonard R. Leo
(74) *Attorney, Agent, or Firm*—Lowe Hauptman & Berner, LLP

(57) ABSTRACT

A stack type heat exchanger includes a plurality of unit frames stacked on one another, each unit frame including a tube made by combining a pair of plates and forming a path for refrigerant and upper and lower tanks disposed at upper and lower ends of the tube, a radiation fin provided between the stacked tubes, an inlet pipe and an outlet pipe provided at one side of the unit frames through which refrigerant enters and is exhausted, a first burr formed in the lower tank to protrude in a direction opposite to a direction in which the refrigerant flows, and a second burr formed in the upper tank to protrude in the same direction as the direction in which the refrigerant flows.

9 Claims, 6 Drawing Sheets

STACK TYPE HEAT EXCHANGER

BACKGROUND OF THE INVENTION

This application claims the priority of Korean Patent Application No. 2002-40393 filed on Jul. 11, 2002 in the Korean Intellectual Property Office, the disclosure of which is incorporated herein in its entirety by reference.

1. Field of the Invention

The present invention relates to a stack type heat exchanger used as an evaporator of an air conditioner for a car, and more particularly, to a stack type heat exchanger having an improved inner structure to enhance cooling performance.

2. Description of the Related Art

A heat exchanger exchanges heat by making two fluids having different temperatures directly or indirectly contact each other. The heat exchanger includes a path through which heat exchange medium flows. While the heat exchange medium flows in the path, heat exchange with outside air is performed. A variety of types of heat exchangers are provided in an air conditioning system of a car. For example, there is a heater core for heating a car, a radiator for cooling the engine of a car, a condenser and an evaporator for cooling a car, and an oil cooler for cooling oil for an automatic transmission.

Among the above heat exchangers, the heat exchanger for an evaporator has been developed in various ways according to the type of refrigerant used as a heat exchange medium and internal pressure generated in the heat exchanger. Typically, there is a fin tube type, a serpentine type, a drawn cup type, a parallel flow type, and a plate and fin type which is referred to as a stack type.

FIG. 1 is a perspective view illustrating a stack type heat exchanger disclosed in Japanese Utility Model Publication No. hei 7-12778 which is an example of a heat exchanger for an evaporator.

Referring to FIG. 1, a conventional stack type heat exchanger 10 is made by stacking a plurality of unit frames, each of which includes a pair of parallel flat tubes 22 formed by combining a pair of plates and through which refrigerant flows and a tank 31 disposed at each of upper and lower ends of the flat tubes 22. The stacked flat tubes 22 and radiation fins 24 interposed between the flat tubes 22 constitutes a heat exchange core portion 20. The tanks 31 are stacked to form first through fourth tank groups 41 through 44. However, although a third tank group is not shown in the drawing, the position thereof can be easily understood. The tanks in the different tank groups are not connected to each other. An inlet pipe 11 and an outlet pipe 12 are provided at the tank at an end of the first tank group 41 in a direction of +X axis and the tank at an end of the second tank group 42 in the same direction, respectively. A connection unit 51 is provided at the opposite ends of the first and second tank groups 41 and 42 in a direction of −X axis.

FIG. 2 is a perspective view illustrating the flow of refrigerant inside the heat exchanger of FIG. 1. Although constituent elements are not detailed in the drawing, they may be easily understood by referring to FIG. 1.

According to FIG. 2, refrigerant coming into the tank of the first tank group 41 through the inlet pipe 11 flows downward and upward along the flat tubes 22 by being blocked by a blocking plate 33 installed at a tank in a middle portion of the first tank group 41. The refrigerant flows toward the tank of the second tank group 42 through the connection unit 51. Then, the refrigerant flows downward and upward along the flat tubes 22 by being blocked by a blocking plate 34 installed at a tank in a middle portion of the second tank group 42, and is exhausted through the outlet pipe 12.

When the above flow of refrigerant is viewed in terms of the blocking plates 33 and 34, in a first flow I between the inlet pipe 11 and the blocking plate 33, the refrigerant concentrates around the inlet pipe 11 by being affected by the gravity. In a second flow II between the blocking plate 33 and the connection unit 51, the refrigerant concentrates around the connection unit 51 due to a inertia force. Similarly, in a third flow III between the connection unit 51 and the blocking plate 34, the refrigerant concentrates around the connection unit 51. In a fourth flow IV between the blocking plate 34 and the outlet pipe 12, the refrigerant concentrates around the outlet pipe 12.

As a result, the refrigerant may concentrate in peripheral portions of the heat exchange core portion 20. Thus, the temperature of air exhausted into the inside of a car is irregular and cooling performance of an air conditioner is deteriorated.

In the meantime, Japanese Patent Publication No. 2000-105091 discloses a stack type heat exchanger in which a protruding portion for determination of a stack position is formed on a combined surface of a tank to easily determine the stacking position of the tanks, equipments are automated by depressing a connection hole, and the amount of pressure drop in refrigerant can be reduced.

Further, Japanese Patent Publication No. hei 10-325645 discloses a stack type heat exchanger in which a bypass route having an area smaller than an area of a refrigerant path for evaporation is provided at least one position of a heat exchange unit to increase the amount of lubricate flowing in a compressor.

However, in these heat exchangers, since the heat exchanger is uniformly designed with respect to the direction of flow of refrigerant without considering the gravity and inertia at the respective portions of the heat exchanger, the irregular concentration of the refrigerant may occurs.

SUMMARY OF THE INVENTION

To solve the above and/or other problems, the present invention provides a stack type heat exchanger used as an evaporator which makes refrigerant uniformly distributed in a core portion so that the distribution of temperature of air exhausted from the evaporator is made uniform.

Also, the present invention provides a stack type heat exchanger which improves cooling performance of an air conditioner.

According to an aspect of the present invention, a stack type heat exchanger including a plurality of unit frames stacked on one another, each unit frame including a tube made by combining a pair of plates and forming a path for refrigerant and upper and lower tanks disposed at upper and lower ends of the tube, a radiation fin provided between the stacked tubes, and an inlet pipe and an outlet pipe provided at one side of the unit frames through which refrigerant enters and is exhausted, the stack type heat exchanger comprising: a first burr formed in the lower tank to protrude in a direction opposite to a direction in which the refrigerant flows; and a second burr formed in the upper tank to protrude in the same direction as the direction in which the refrigerant flows.

The tube of each of the unit frames comprises a pair of first and second tubes which are parallel to and independent of each other, the lower tank of each of the unit frames comprise first and second tanks which are connected to the first and second tubes, respectively, and independent of each other, the upper tank of each of the unit frames comprise third and fourth tanks which are connected to the first and second tubes, respectively, and independent of each other, the first through fourth tanks are brazing combined in a direction of the same axis such that the same tanks are connected to each other, and the first burr is formed in each of the first and second tanks and the second burr is formed in each of the third and fourth tanks.

The inlet pipe and the outlet pipe are connected to the first and second tank groups, respectively.

At least one tank of the first tank group and at least one tank of the second tank group are connected each other for circulation of the refrigerant.

The stack type heat exchanger further comprises a connection unit which is interposed between the first tank and the second tank to connect the first tank and the second tank so that the first tank group and the second tank group are connected.

The connection unit is integrally formed with the plates constituting adjacent unit frames.

At least one tank of the third tank group and at least one tank of the fourth tank group are connected each other for circulation of the refrigerant.

The stack type heat exchanger further comprises a connection unit which is interposed between the third tank and the fourth tank to connect the third tank and the fourth tank so that the third tank group and the fourth tank group are connected. The connection unit is integrally formed with the plates constituting adjacent unit frames.

BRIEF DESCRIPTION OF THE DRAWINGS

The above and other features and advantages of the present invention will become more apparent by describing in detail preferred embodiments thereof with reference to the attached drawings in which.

DETAILED DESCRIPTION OF THE INVENTION

Figure 1:
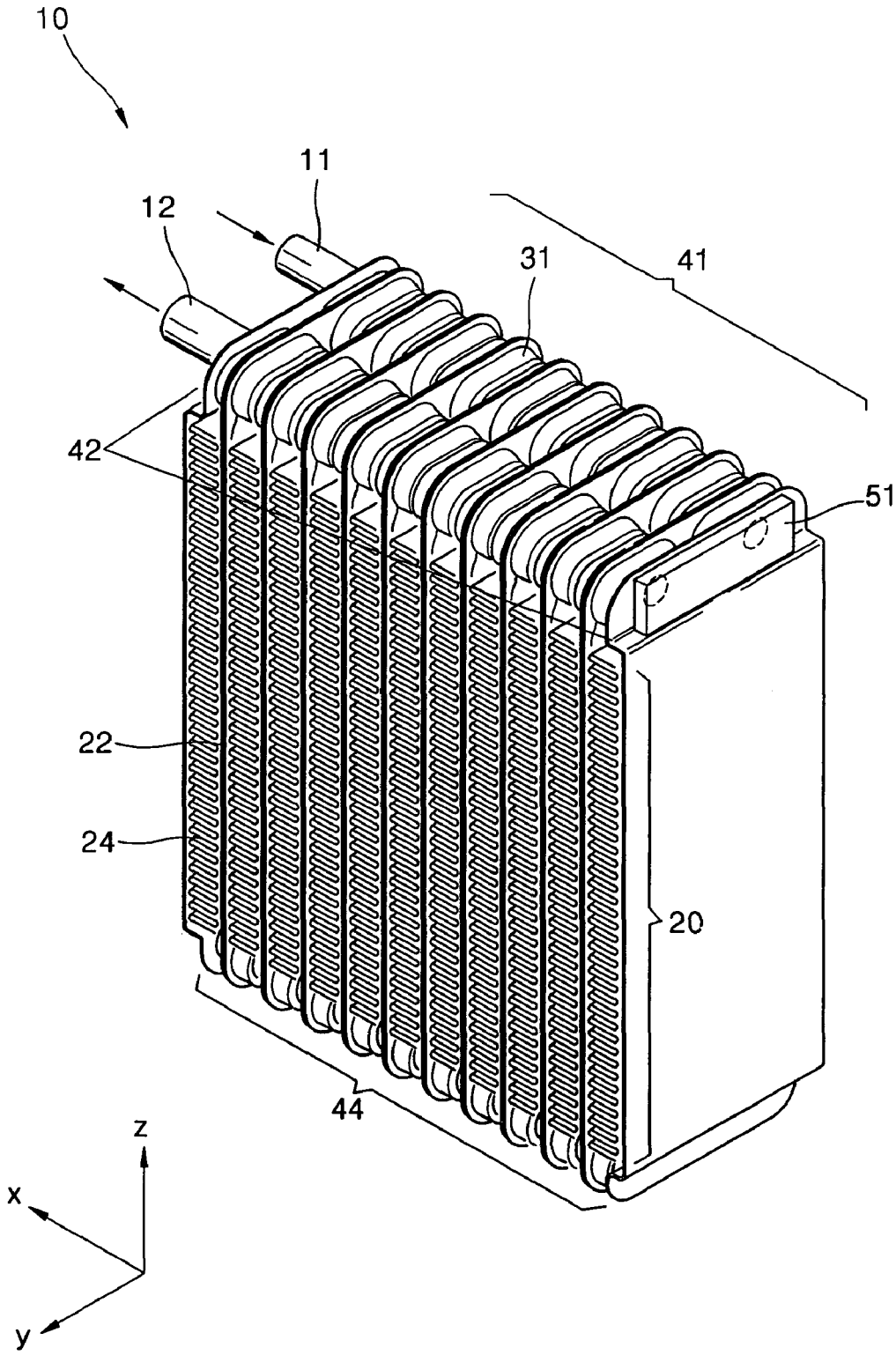
FIG. 1 (PRIOR ART)
FIG. 1 is a perspective view illustrating a conventional stack type heat exchanger which is used as an evaporator of an air conditioner for a car.
Figure 2:
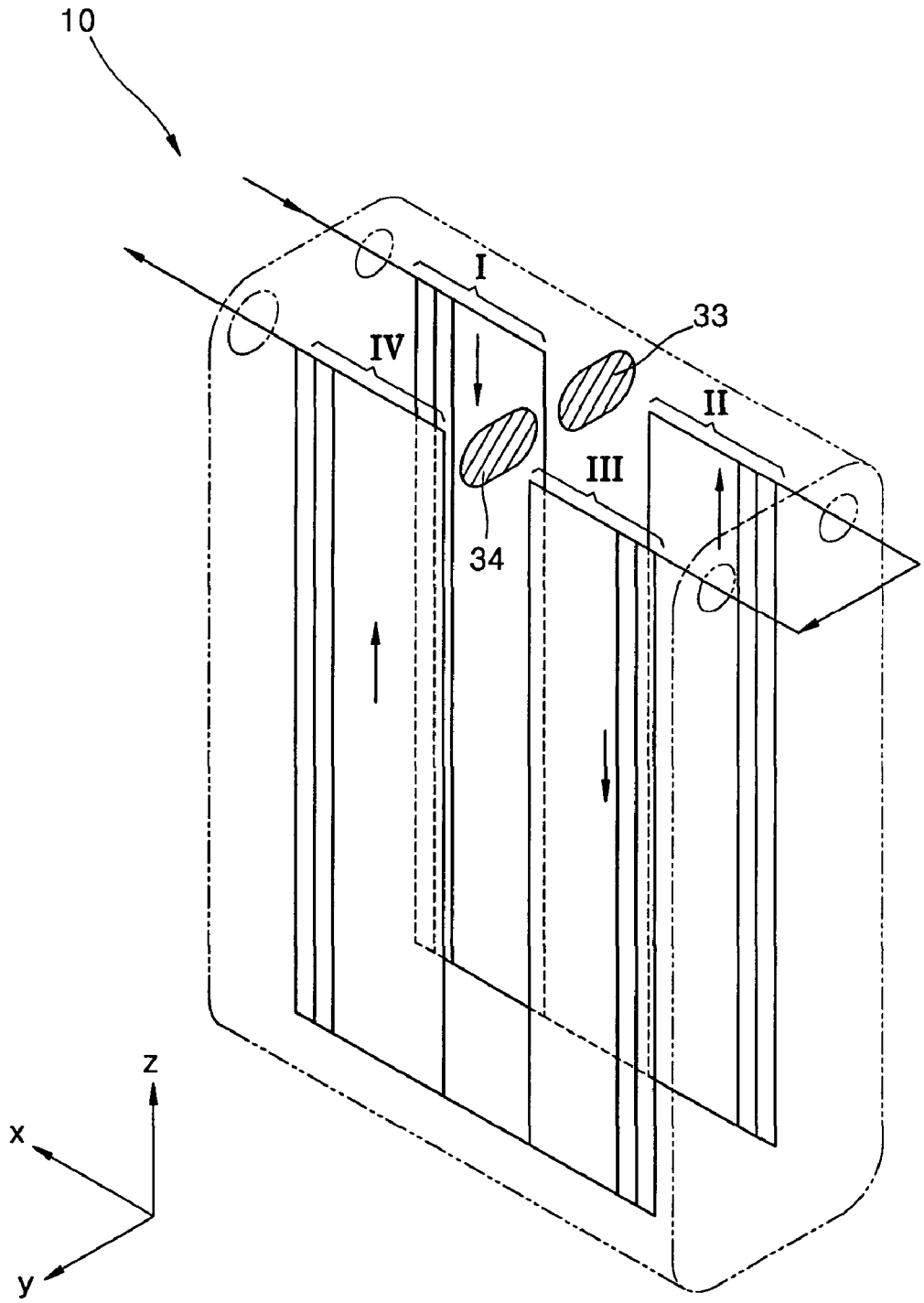
FIG. 2 (PRIOR ART)
FIG. 2 is a perspective view illustrating the flow of a heat exchange medium in the stack type heat exchanger of FIG. 1.
Figure 3:
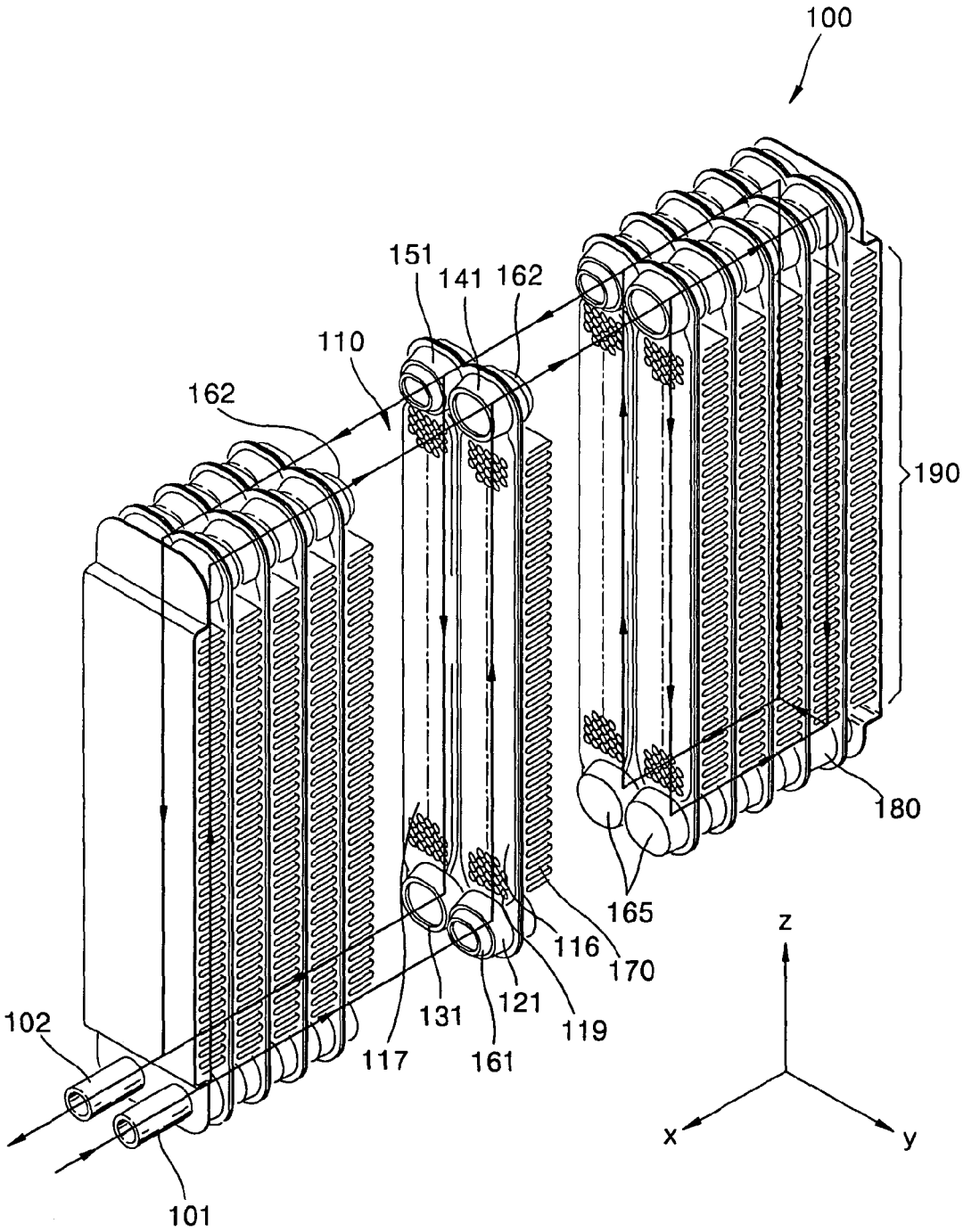
FIG. 3 is a perspective view illustrating a stack type heat exchanger according to a preferred embodiment of the present invention which is used as an evaporator of an air conditioner for a car.
Figure 4:
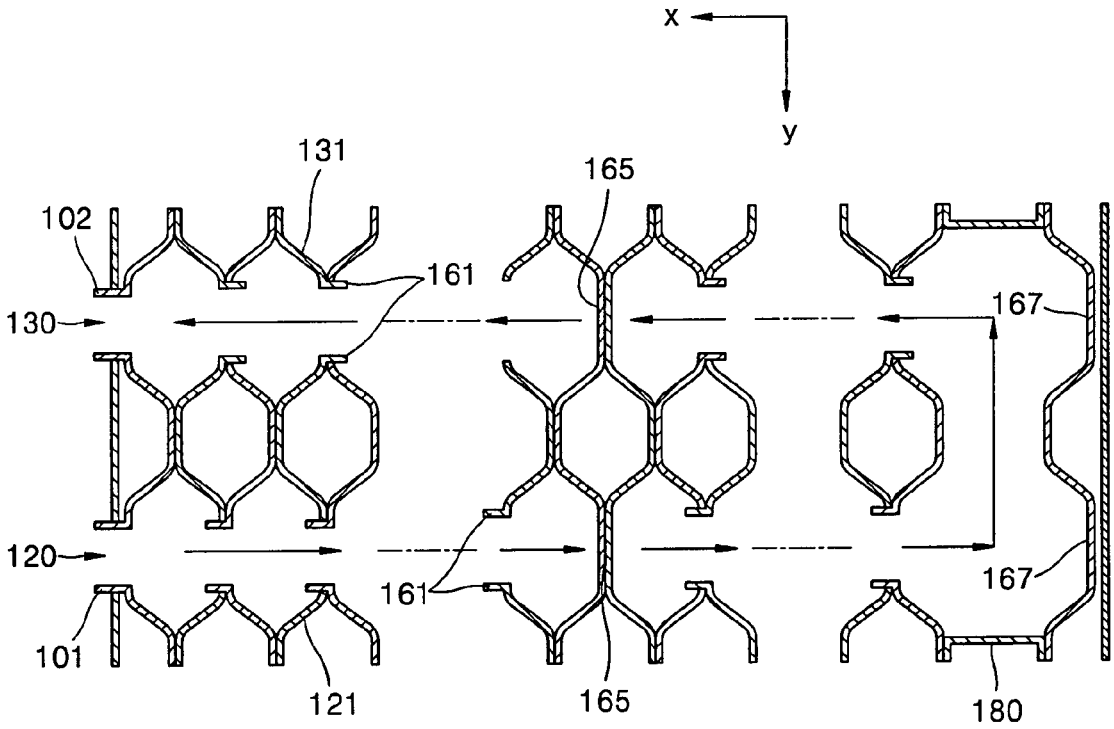
FIG. 4 is a sectional view illustrating the stack type heat exchanger of FIG. 3 by cutting a tank group at a lower end of the heat exchanger.
Figure 5:
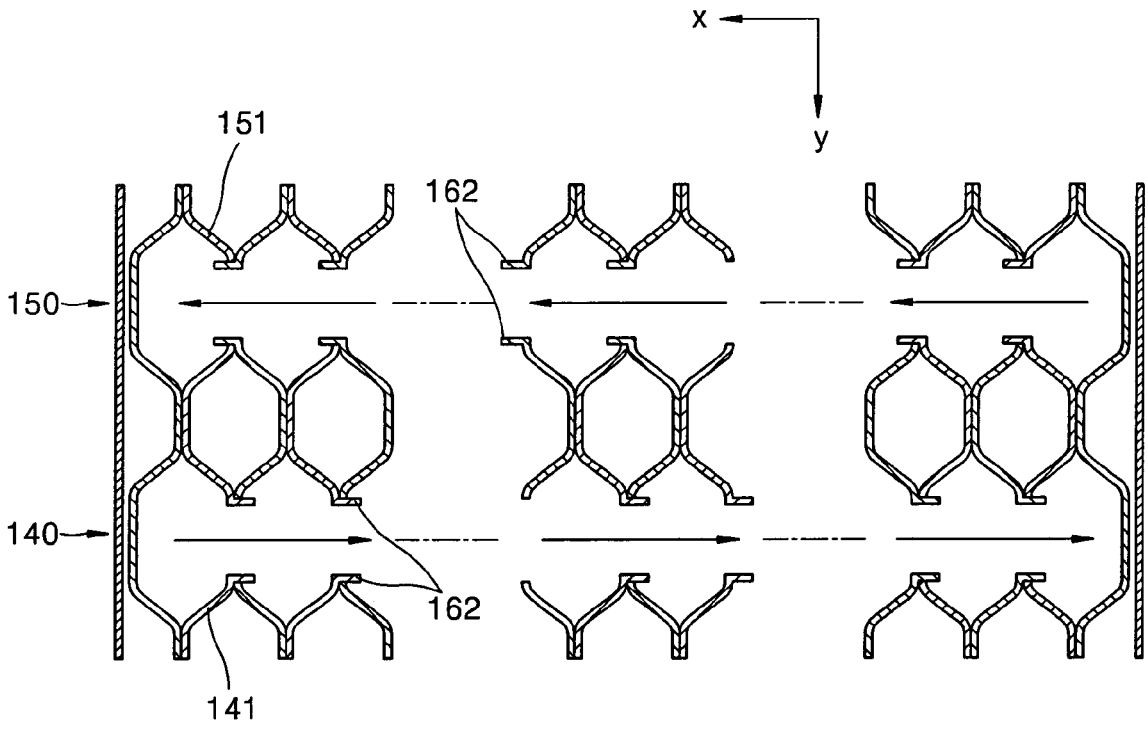
FIG. 5 is a sectional view illustrating the stack type heat exchanger of FIG. 3 by cutting a tank group at an upper end of the heat exchanger.

FIG. 3 shows a stack type heat exchanger according to a preferred embodiment of the present invention which is used as an evaporator of an air conditioner for a car. FIGS. 4 and 5 are sectional views illustrating first and second tank groups at a lower portion of the stack type heat exchanger shown in FIG. 3 and third and fourth tank groups at an upper portion thereof, respectively.

Referring to the drawings, in a stack type heat exchanger 100 according to a preferred embodiment of the present invention, a unit frame 110 is formed by combining a pair of plates and a plurality of the unit frames 100 are stacked. Each unit frame 110 includes a tube which is a path for refrigerant and upper and lower tanks disposed at the upper and lower ends of the tube.

According to a preferred embodiment of the present invention, the tube includes a pair of first and second tubes 116 and 117 which are parallel to each other and independent of each other. The lower tank includes first and second tanks 121 and 131 disposed at the lower end of each of the first and second tubes 116 and 117. The upper tank includes third and fourth tanks 141 and 151 disposed at the upper end of each of the first and second tubes 116 and 117. The first and second tanks 121 and 131 are independent of each other and connected to the first and second tubes 116 and 117, respectively. The third and fourth tanks 141 and 151 are independent of each other and connected to the first and second tubes 116 and 117, respectively.

A radiation fin 170 is provided between the first and second tubes 116 and 117 to facilitate heat exchange between the refrigerant and the external air. Also, a plurality of dimples 119 are formed on flat surfaces of the tubes 116 and 117 to 30 facilitate heat exchange. The tubes 116 and 117 and the radiation fin 170 constitutes a heat exchange core portion 190 which performs heat exchange between the refrigerant located inside and the outside air.

The first through fourth tanks 121, 131, 141, and 151 are brazing-combined in a direction along an X axis so that the same tanks can be connected one another, thus constituting the first through fourth tank groups 120, 130, 140, and 150 in which the refrigerant flows, as shown in FIGS. 4 and 5. Here, different tank groups are separated so as not to be directly connected to one another. An inlet pipe 101 and an outlet pipe 102 through which the refrigerant enters and is exhausted are provided at the first tank 121 and the second tank 131 at an end portion in the X-axis direction. Thus, the inlet pipe 101 and the outlet pipe 102 are connected to the first and second tank groups 120 and 130, respectively.

A predetermined tank at a middle portion which belongs to the first and second tank groups 120 and 130 is blocked by a blocking wall 165. The refrigerant entering the heat exchanger 100 flows along the tubes 116 and 117 of the heat exchange core portion 190 by the blocking wall 165. The blocking wall 165, as shown in FIGS. 3 and 4, can be integrally formed with a plate forming the unit frame 110.

At least one tank of the first and second tank groups 120 and 130 are connected to each other for circulation of the refrigerant therebetween. According to a preferred embodiment of the present invention, as shown in FIG. 4, the first tank 121 and the second tank 131 at the farthermost positions opposite to the inlet pipe 101 and the outlet pipe 102 can be connected to each other. The first tank group 120 and the second tank group 130 can be connected by an additional connection unit 180.

Figure 6:
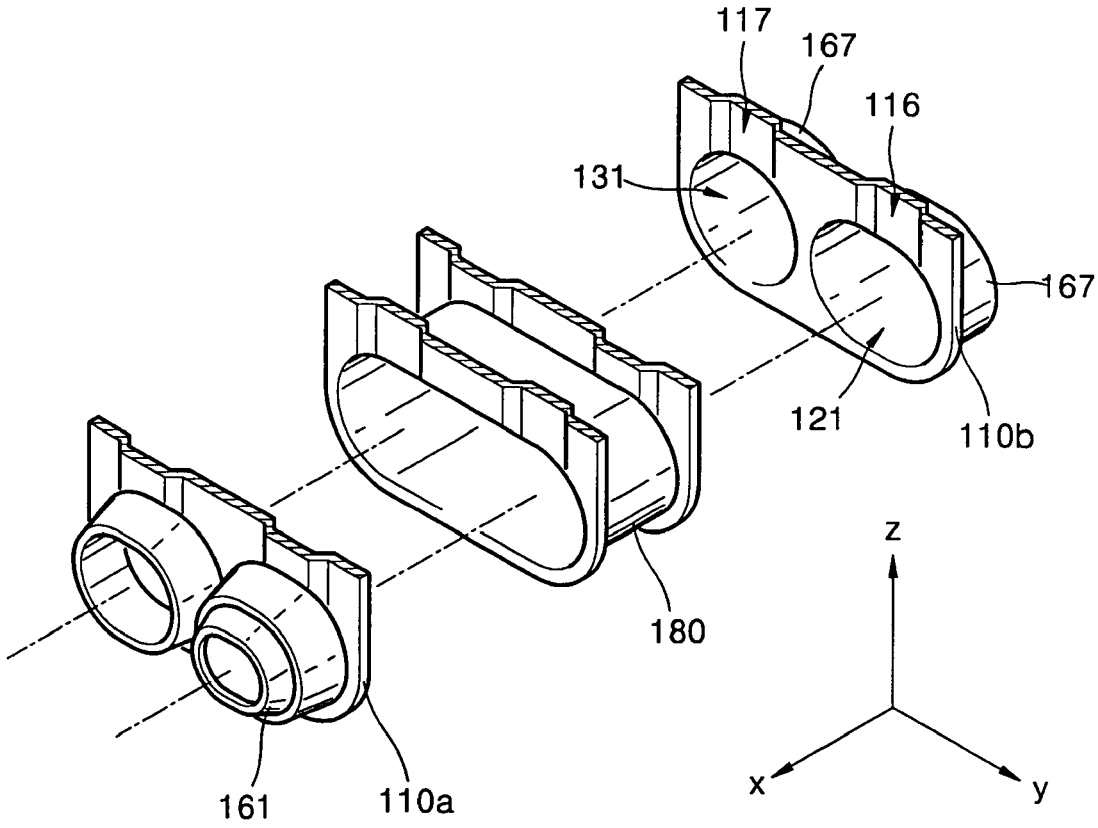
FIG. 6 is an exploded perspective view illustrating a manifold of the stack type heat exchanger of FIG. 3.

FIG. 6 is an exploded perspective view illustrating a preferred embodiment of the connection unit 180 in the stack type heat exchanger of FIG. 3. Referring to FIG. 6, the connection unit 180 is provided between the lower tanks of a first plate 110*a* and a second plate 110*b* constituting the unit frame 110 of FIG. 3 and brazed to each other so that the first and second tanks 121 and 131 are connected to each other. The second plate 110*b* is disposed at the farthermost position of the heat exchanger and the tank is closed by a blocking wall 167. Accordingly, the refrigerant entering through the first tube 116 or an adjacent first tank (not shown) flows along the connection unit 180 only to proceed toward the second tube 117 or an adjacent second tank (not shown). The connection unit 180, as shown in FIGS. 3 through 6, can be not only disposed at the farthermost position of the heat exchanger but also in a middle portion of the heat exchanger, so that the refrigerant can flow in a variety of flow routes.

Also, the connection unit 180 can have a variety of shapes, for example, by being integrally formed with a plate constituting an adjacent unit frame. That is, although not shown in the drawings, a connection unit is formed by integrally forming the connection unit 180 in each of the second plate of a unit frame and the first plate of a unit frame adjacent thereto and combining the second and first plates.

In the present invention, at least one tank of each of the third tank group and the fourth tank group can be connected for circulation of the refrigerant. The third and fourth tank groups can be connected by the above-described connection unit. Since the connection unit to connect the third and fourth tank groups are the same as the above-described connection unit, a detailed description thereof will be omitted.

In the meantime, a first burr 161 protrudes at an edge of each of the first and second tanks 121 and 131 forming the lower tank at the lower portion of the heat exchanger, in the opposite direction to a direction in which the refrigerant flows as indicated by arrows. A second burr 162 protrudes at an edge of each of the third and fourth tanks 141 and 151 forming the upper tank at the upper portion of the heat exchanger, in the same direction as the direction in which the refrigerant flows. The first and second burrs 161 and 162 are provided to make the refrigerant uniformly distributed. The first burr 161 functions as resistance to the flow of the refrigerant in the first and second tank groups 120 and 130 in the direction of flow while the second burr 162 helps the refrigerant flow in the third and fourth tanks 140 and 150 in the direction of flow. The first and second burrs 161 and 162 protruding in one side of the tank are inserted in an opening formed at the other side of an adjacent tank and brazing combined.

That is, as shown in FIG. 4, the first burr 161 protrudes from the first tank 121 and the second tank 131 constituting the lower tank in the opposite direction to the direction in which the refrigerant flows which is indicated by arrows. Here, the first burr 161 preferably protrudes into an inner space of each of the first and second tanks 121 and 131, as shown in FIG. 4, and is preferably formed at least parallel to the direction in which the refrigerant flows.

In the first and second tank groups 120 and 130 disposed at the lower portion of the heat exchanger, the refrigerant is further affected by inertia rather than the gravity so that the refrigerant is inclined to proceed forward along the direction in which the refrigerant flows. The forward proceeding feature of the refrigerant is resisted by the first burr 161. Consequently, the refrigerant flows in the first and second tubes 116 and 117 respectively connected to the first and second tank groups 120 and 130 so that the refrigerant is uniformly distributed in the heat exchange core portion 190. Thus, in the present invention, the first burr 161 may have any of structures capable of performing a function of resisting the flow of the refrigerant. That is, although not shown in the drawings, the first burr 161 can be extended by being inclined at a predetermined angle with respect to the direction in which the refrigerant flows and formed to have a protruding length reaching a predetermined position in the inner space of each of the first and second tanks. However, when the first burr 161 is formed too lengthy, since the refrigerant is hindered from flowing in the first and second tubes, the first burr 161 is preferably formed to have an appropriate length.

The second burr 162 formed in the upper tank, as shown in FIG. 5, protrudes in the third and fourth tanks 141 and 151 constituting the upper tank in a direction corresponding to the direction in which the refrigerant flows indicated by arrows. Here, like the above-described first burr 161, the second burr 162 preferably protrudes to the inner space of each of the third and fourth tanks 141 and 151 and parallel to the direction in which the refrigerant flows.

In the third and fourth tank groups 140 and 150 disposed at the upper portion of the heat exchanger, the refrigerant is further affected by the gravity rather than inertia so that the refrigerant is inclined to fall downward in the direction of the gravity. The falling feature of the refrigerant is resisted by the second burr 162. Consequently, the refrigerant sufficiently flows to the end portion of each of the third and fourth tank groups 140 and 150 along the direction in which the refrigerant flows so that the refrigerant is uniformly distributed in the heat exchange core portion 190. Thus, in the present invention, the second burr 162 may have any of structures capable of helping the flow of the refrigerant. That is, although not shown in the drawings, the second burr 162 can be extended by being inclined at a predetermined angle with respect to the direction in which the refrigerant flows and formed to have a protruding length reaching a predetermined position in the inner space of each of the third and fourth tanks. However, like the above-described first burr 161, when the second burr 162 is formed too lengthy, since the refrigerant is hindered from flowing in the first and second tubes, the second burr 162 is preferably formed to have an appropriate length.

In the operation of the stack type heat exchanger according to the present invention in terms of the flow of refrigerant, referring to FIGS. 3 through 5, the refrigerant exhausted from an expansion valve (not shown) enters the first tank group 120 through the inlet pipe 101 of FIG. 3 of the heat exchanger. The entering refrigerant is greatly affected by the inertia more than the gravity. However, the influence by the inertia on the refrigerant in the first tank group 120 is reduced by the first burr 161 protruding in the opposite direction to the direction in which the refrigerant flows. Accordingly, the refrigerant can be uniformly distributed in the first tank group 120 and the first tube 116 connected thereto.

The refrigerant passes through the first tube 116 and flows into the third tank group 140 by the blocking wall 165 at the middle portion of the first tank group 120. The refrigerant in the third tank group 140 is greatly affected by the gravity more than the inertia. However, the influence by the gravity on the refrigerant in the third tank group 140 is reduced by the second burr 162 protruding in the same direction as the direction in which the refrigerant flows. Accordingly, the refrigerant does not instantly fall down to the lower portion of the heat exchanger and can be uniformly distributed in the third tank group 140.

The refrigerant enters the second tank group 130 through a manifold that is the connection unit 180 connecting the first and second tanks 121 and 131 at the farthermost positions opposite to the inlet and outlet pipes 101 and 102. Here, the flow of the refrigerant is the same as that in the first tank group 120 so that the refrigerant can be uniformly distributed in the second tank group 130 by the first burr 161 protruding in the opposite direction to the direction in which the refrigerant flows.

Then, the refrigerant enters the fourth tank group 150 by being blocked by the blocking wall 165 at the middle portion of the second tank group 130 and flows in the same direction as that in the third tank group 140. Thus, the refrigerant can be uniformly distributed in the fourth tank group 150 by the second burr 162 in the same direction as the direction in which the refrigerant flows.

The refrigerant flowing through the first and second tubes 116 and 117 of the heat exchange core portion 190 proceeds toward a compressor through the outlet pipe 102. As a result, since the refrigerant can flow in the heat exchange core portion 190 by being uniformly distributed therein, so that the outside air passing through the heat exchange core portion 190 can be uniformly cooled.

As described above, in the stack type heat exchanger according to the present invention, since the refrigerant entering the heat exchanger is uniformly distributed in the heat exchange core portion, the exhaust air on the core surface passing through the heat exchange core portion to make the temperature of the air uniform. Accordingly, cooling performance of the air conditioner for a car can be improved.

Also, in the preferred embodiment of the present invention, although a plurality of dimples are formed to facilitate exchange of heat in the tube, a structure in which an additional inner fin is inserted instead of the dimples is possible. In the meantime, the manifold can be manufactured integrally with the tube or a farthermost support.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A stack type heat exchanger, comprising:

a plurality of unit frames stacked on one another, each unit frame including a pair of first and second tubes which are parallel to and independent of each other, each of the first and second tubes comprising a pair of plates combined with each other and forming a path for refrigerant, first and second tanks which are disposed at and connected to lower ends of the first and second tubes, respectively, and are independent of each other, and third and fourth tanks which are disposed at and connected to upper ends of the first and second tubes, respectively, and are independent of each other;

radiation fins provided between the tubes of the stacked unit frames;

an inlet pipe and an outlet pipe which are provided at one side of the stacked unit frames and through which the refrigerant enters and is exhausted, respectively;

first burrs which are formed in the first and second tanks and protrude in a direction opposite to a direction in which the refrigerant flows so as to provide resistance to the refrigerant flows in the first and second tanks; and second burrs which are formed in the third and fourth tanks and protrude in the same direction in which the refrigerant flows so as to protrude the refrigerant flows in the third and fourth tanks;

wherein, in each of said unit frames, the first and fourth tanks are diagonally arranged with respect to each other, and the second and third tanks are diagonally arranged with respect to each other, and the first burr formed in the first tank protrudes in the same direction as the second burr formed in the fourth tank, and the first burr formed in the second tank protrudes in the same direction as the second burr formed in the third tank.

2. The stack type heat exchanger as claimed in claim 1, wherein the first tanks of said unit frames are connected, by brazing, with each other along a stacking direction of said stacked unit frames to form a first tank group;

the second tanks of said unit frames are connected, by brazing, with each other along the stacking direction of said stacked unit frames to form a second tank group;

the third tanks of said unit frames are connected, by brazing, with each other along the stacking direction of said stacked unit frames to form a third tank group; and the fourth tanks of said unit frames are connected, by brazing, with each other along the stacking direction of said stacked unit frames to form a fourth tank group.

3. The stack type heat exchanger as claimed in claim 2, wherein the inlet pipe and the outlet pipe are connected to the first and second tank groups, respectively.

4. The stack type heat exchanger as claimed in claim 2, wherein at least one tank of the first tank group and at least one tank of the second tank group are connected to each other for circulation of the refrigerant.

5. The stack type heat exchanger as claimed in claim 4, further comprising a connection unit which is interposed between and connected said at least one tank of the first tank group and said at least one tank of the second tank group so that the first tank group and the second tank group are connected.

6. The stack type heat exchanger as claimed in claim 5, wherein the connection unit is integrally formed with the plates constituting adjacent unit frames.

7. The stack type heat exchanger as claimed in claim 2, wherein at least one tank of the third tank group and at least one tank of the fourth tank group are connected to each other for circulation of the refrigerant.

8. The stack type heat exchanger as claimed in claim 7, further comprising a connection unit which is interposed between and connected said at least one tank of the third tank group and said at least one tank of the fourth tank group so that the third tank group and the fourth tank group are connected.

9. The stack type heat exchanger as claimed in claim 8, wherein the connection unit is integrally formed with the plates constituting adjacent unit frames.

* * * * *